United States Patent [19]

Stifano, Jr.

[11] 4,295,395

[45] Oct. 20, 1981

[54] TOOL ATTACHMENT HAVING SPRING EJECT RELEASE

[75] Inventor: Vincent A. Stifano, Jr., Wethersfield, Conn.

[73] Assignee: Veeder Industries Inc., Hartford, Conn.

[21] Appl. No.: 36,797

[22] Filed: May 7, 1979

[51] Int. Cl.[3] ..... B25B 13/06

[52] U.S. Cl. ..... 81/121 R; 81/177 G

[58] Field of Search ..... 81/121 R, 121 B, 124.1, 81/177 A, 177 G

[56] References Cited

U.S. PATENT DOCUMENTS

| | | | |
|---|---|---|---|
| 897,055 | 8/1908 | Bowers | 81/177 G X |
| 1,469,662 | 10/1923 | Leopold | 81/121 R |
| 2,651,230 | 9/1953 | Waterval | 81/177 G X |
| 2,699,082 | 1/1955 | Viets | 81/177 G X |
| 2,954,994 | 10/1960 | Beers | 81/177 G X |

*Primary Examiner*—James G. Smith

*Attorney, Agent, or Firm*—Hayes & Reinsmith

[57] ABSTRACT

A tool is provided having a drive member and a tool attachment of a push-button release snap-on type releasably secured in the drive member of the tool. The tool includes a camming surface and a recess on one of the drive and tool attachment members, and a resiliently biased locking detent on the other of the members. Upon being disengaged from a normal operating position in the recess, the detent engages and cooperates with the camming surface to positively and automatically eject the attachment from the drive member.

10 Claims, 8 Drawing Figures

TOOL ATTACHMENT HAVING SPRING EJECT RELEASE

This invention generally relates to tools and particularly concerns hand tools of a type featuring a push-button release snap-on attachment having a suitable fastener driving element.

A primary object of this invention is to provide a new and improved tool particularly suited to effect an automatic spring eject assist for tool attachment release in response to an initial manual movement of the tool attachment relative to the tool body.

Another object of this invention is to provide a new and improved tool of the type described particularly useful with hand tools such as ratchet drive wrenches and complementary socket attachments.

A further object of this invention is to provide such a tool which is designed to provide an axial length of driving engagement between the tool body and the tool attachment which is of increased dimension relative to the axial length of the exposed tool attachment for improved stability and minimized tolerance requirements.

Yet another object of this invention is to provide a new and improved tool attachment usable in a tool drive member and which is particularly dimensioned and configured to provide increased strength and stress resistance in the attachment relative to its drive section and which is quick and easy to economically manufacture in mass production quantities.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

Figures 1, 2, 3, 4, 5:
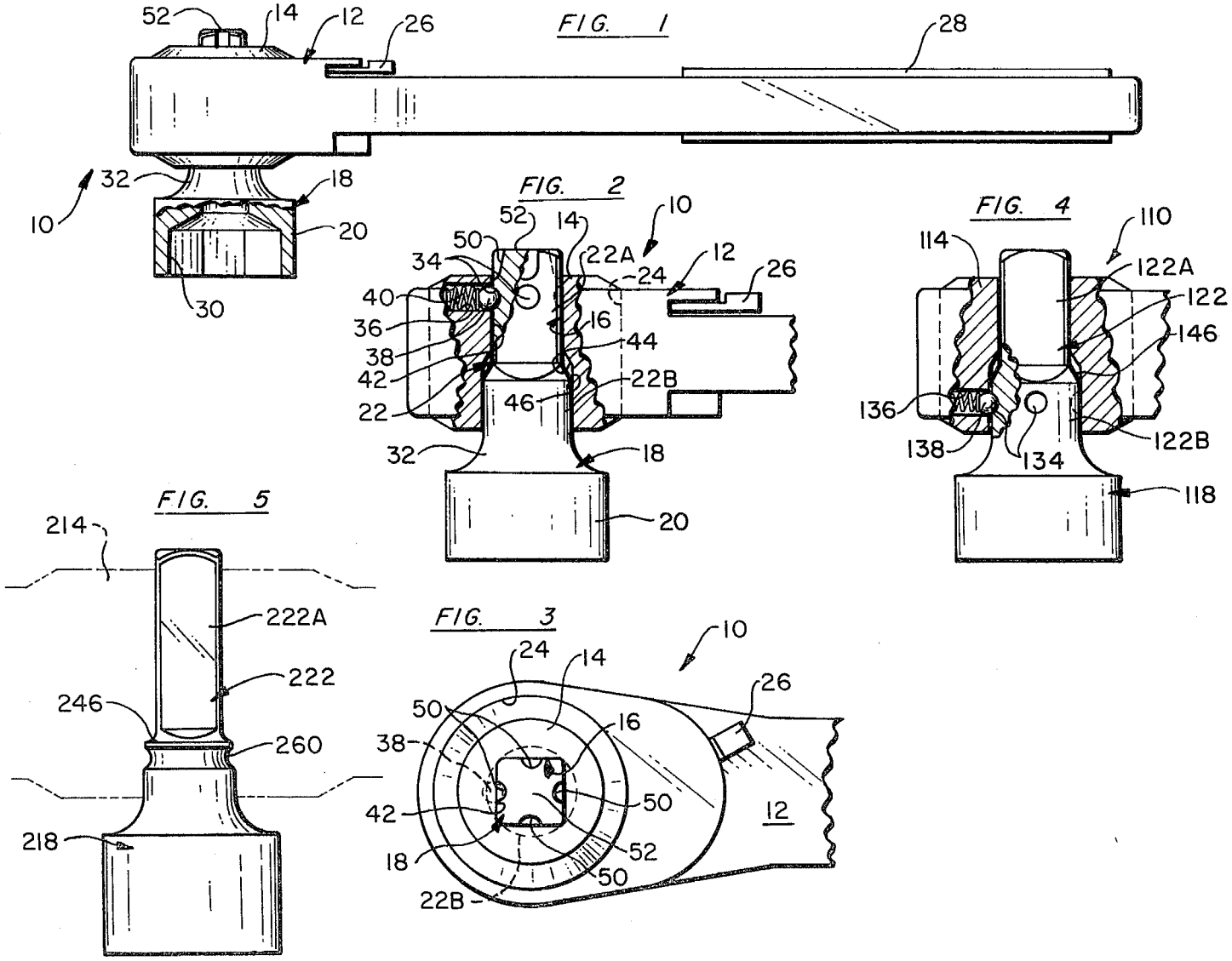
FIG. 1 is a side view, partly broken away and partly in section, showing a tool of a type with which this invention is suited to be used.
FIG. 2 is an enlarged side view, partly broken away and partly in section, showing a drive member and attachment of the tool of FIG. 1.
FIG. 3 is a plan view, partly broken away, of the tool of FIG. 2.
FIG. 4 is a view similar to FIG. 2 showing another embodiment of this invention.
FIG. 5 is a side view of a tool attachment incorporating a third embodiment of this invention.

Referring to the drawings in detail, a tool 10 is shown in FIGS. 1–3 of a type with which this invention is particularly useful and comprises a body 12, a drive member 14 with a non-circular opening 16 and a tool attachment 18 having a fastener driving element 20 and a shank 22 which is dimensioned and configured to be received within the opening 16 in driving engagement with the drive member 14.

While this invention is suitable for use in a variety of different tool applications, the preferred embodiments are shown for illustrative purposes incorporated in a ratchet drive socket wrench such as shown at 10. A ratchet wheel 14 is supported for rotation in a conventional manner in an opening 24 at one end of the wrench body 12. The ratchet wheel construction itself is not part of this invention, and it will suffice for purposes of explanation to note that a spring biased pawl 26 may be moved into either of two angularly displaced operating positions wherein the pawl 26 is urged into engagement with teeth, not shown, of ratchet wheel 14 for rotation in a selected angular direction responsive to manual actuation of wrench handle 28.

Ratchet wheel 14 is shown having a square hole 16 in the center of the wheel for receiving the square drive shank 22 of attachment 18 which has a socket 30 within fastener driving element 20, the internal walls of which will be understood to conform to the external configuration of a particular size fastener.

The above-described socket wrench 10 is simplified in comparison to a number of conventional socket sets which normally have a built-in drive element within the ratchet wheel. Such conventional sets normally have a protruding drive tang which projects beyond the profile of the ratchet wheel for attaching a socket with the socket being exposed in its entirety outside the ratchet wheel envelope. In the preferred embodiments of this invention, improved tool stability and minimized tolerance requirements are achieved (1) by providing the tool attachment shank 22, i.e., that portion of the attachment 18 confined within the opening 16 of the ratchet wheel 14, with an axial length greater than the combined axial length of the exposed flared neck section 32 and the fastener driving socket 20, and (2) by axially dimensioning the flared neck section 32 to be less than the axial dimension of the socket 20 itself. Moreover, in comparison to the above-referenced conventional socket sets, the overall axial dimension of the tool attachment of this invention in operating position at the ratchet end of the wrench 10 is less than the corresponding overall axial dimension of the attachments of conventional tool sets.

To additionally provide an attachment of improved design which is economical to manufacture in a facile manner while providing a fastener driving element of increased strength and stress resistance, intermediate circular shank section 22B (between the exposed flared neck section 32 and square drive shank section 22A) is of a circular cross-section and is formed with a minimum cross-sectional area at least equal to or greater than the maximum cross-sectional area of the square drive shank section 22A confined within ratchet wheel 14. By virtue of the above-described construction, the socket attachment 18 of this invention is particularly suited for reliable performance under demanding conditions over an extended service life.

The square drive shank 22 is shown in an operating position in FIG. 2 having a recess 34 formed in section 22A such that the recess 34 precisely registers with a chamber 36 in ratchet wheel 14 wherein a locking detent ball 38 is mounted and resiliently biased outwardly into engagement with the recessed portion of drive shank 22 by a spring 40 within chamber 36. Spring 40 is compressed within chamber 36 with opposite ends of the spring 40 in pressing engagement against the body of the ratchet wheel 14 and the detent ball 38. Ball 38 is retained within chamber 36 under all conditions, for example, by peening the edges of the entry opening to the chamber 36 to form a constricted entry opening on the surface of internal wall 42 of ratchet wheel 14 and which is of slightly reduced diameter relative to the diameter of the detent ball 38. Accordingly, the square drive shank section 22A of the socket attachment 18 is engaged with ratchet wheel 14 of wrench 10 by inserting the socket attachment into the square hole 16 until the ball 38 is fully seated within its recess 34 to secure socket attachment 18 in its operating position. To eliminate any possibility of a "zero tolerance" condition, internal shoulder 44 within ratchet wheel 14 preferably does not function as a stop in cooperation with external shoulder 46 on shank 18 which is preferably spaced apart from shoulder 44 in operating position. Shoulder 46 joins the drive and intermediate sections 22A and 22B of the shank 22, and with socket attachment 18 in operating position, locking ball 38 is driven into releasable locking engagement with recess 34 by the force of spring 40 to secure the socket attachment 18.

To release the socket attachment 18 from its operating position in a particularly quick and easy manner under a variety of different conditions in accordance with this invention, a camming surface 50 is illustrated in FIG. 2 as being formed on the same member containing the recess 34 in adjacent aligned relation thereto and is specifically shown extending from an outside surface of the drive shank 22 and tapering toward a terminal end 52 of the socket attachment 18. Accordingly, it is only necessary to apply thumb pressure on terminal end 52 of the attachment 18 to initiate its movement in a release direction to drive locking detent 38 out of recess 34 to roll onto the outside surface of maximum dimension of drive section 22A of shank 22 and compress the detent spring 40. As the initial movement of the socket attachment 18 relative to ratchet wheel 14 is effected, ball 38 rolls onto the following camming surface 50. The biasing force of the compressed spring 40 is then applied directly by the detent ball 38 to effect a vector force component axially of the socket attachment shank 22 to positively drive it from the ratchet wheel 14 without further manual assist required to permit the socket attachment 18 to fall free automatically.

In the specifically illustrated embodiment of FIGS. 1–3, no orientation is required of the socket attachment 18 relative to the ratchet wheel opening 16. While only one detent ball 38 is shown mounted within the body of ratchet wheel 14, the four sides of the square drive shank 22 are illustrated as having identically located recesses 34 and adjacent camming surfaces 50 to effect the desired spring eject action on the socket attachment 18.

In the embodiment of tool 110 of FIG. 4, a similar arrangement is shown wherein the detent recess 134 or seat for the ball 138 is formed in an intermediate section 122B of the attachment 118 which is axially aligned with the square drive section 122A. A shoulder 146 between the drive and intermediate sections of the shank 122 serves to provide the desired cam eject effect. The maximum travel of ball 138 is limited by the constricted end-opening of the spring chamber 136 as described above, and the camming shoulder 146 and spring biased ball 138 cooperate to provide sufficient force to positively drive the socket attachment 118 axially to release it from the ratchet wheel 114. The projection of ball 138 relative to socket attachment 118 is limited to a predetermined extent to prevent undesired engagement between ball 138 and the drive surface of shank drive section 122A extending above camming shoulder 146 to eliminate any drag during tool attachment ejection. As in the embodiment of FIGS. 1–3, intermediate shank section 122B is of circular cross-section and of enlarged cross-sectional area (even through a plane containing the detent recesses 134 and forming the minimum area) relative to the maximum cross-sectional area of square drive shank section 122A.

In the embodiment of the tool attachment 218 illustrated in FIG. 5, another modification is shown wherein the lower end of the drive shank 222, which is confined within ratchet wheel 214 when in operating position, is formed with a circumferentially extending groove 260 serving as the detent recess for cooperating with a suitable detent such as the above-described ball to releasably maintain the socket attachment 218 in operating position. The socket attachment is of a design similar to that shown in the previously described embodiments of FIGS. 1–3 and FIG. 4. Shoulder 246 serves as a camming surface, and the minimum cross-sectional area of drive shank 222 is along the longitudinally extending drive section 222A which is engageable with the internal driving surfaces of the ratchet wheel opening. Moreover, it will be noted that the overall axial length of the drive shank 222 received within the ratchet wheel opening is greater than that of the adjacent lower end portion of socket attachment 218 which extends beyond the profile of the wrench when the attachment 218 is in operating position.

Figure 6:
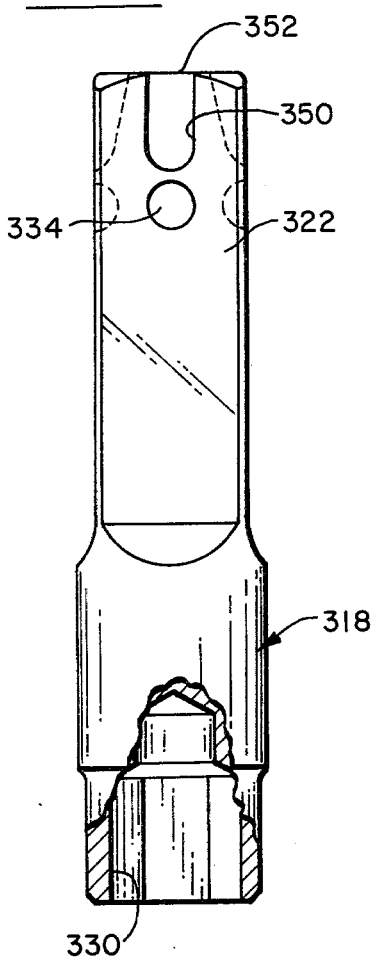
FIG. 6 is a side view, partly broken away and partly in section, showing yet another embodiment of a tool attachment incorporating this invention.
Figure 7:
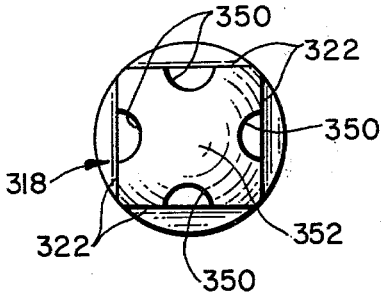
FIG. 7 is a top end view of the attachment of FIG. 6.
Figure 8:
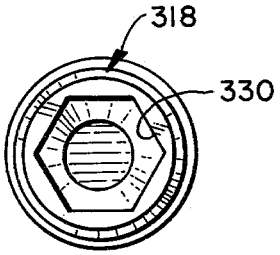
FIG. 8 is a bottom end view of the attachment of FIG. 6.

In the embodiment of FIGS. 6–8, an extension socket attachment 318 is illustrated incorporating the spring eject feature of this invention wherein the detent recess 334 is provided with an adjacent camming surface 350 which tampers to terminal end 352 to provide the desired spring eject effect when mounted in a ratchet wheel similar to that shown in FIG. 2 and which operates as explained in the description of that embodiment. The necessity for any orientation of the extension socket 318 is eliminated by providing corresponding recesses 334 and camming surfaces 350 on each of the drive surfaces 322 of the drive shank as shown in FIG. 7. In addition, while the socket 330 itself is illustrated in FIG. 8 as being adapted to drive a hex nut, e.g., it will be understood that the socket 330 may be modified to match the outside contour of any fastener desired to be driven.

While a single spring-biased detent ball has been described in the various embodiments, a plurality of such detent means may be provided if desired although it has not been found necessary in the application of this invention to drive socket sets of the type shown. Moreover, the specific location of the detent means may be varied, e.g., it may be mounted on a corner between adjacent internal drive walls of the ratchet wheel opening, and different types of detents may be used such as a spring-loaded pin which could be biased for engagement with a detent recess in the corner of the drive shank for subsequent positive spring ejection of the tool attachment upon being driven against the following adjacent camming surface on the drive shank. In the various modifications of this invention, it has been found that free fall of the tool attachment is improved if the surface between the camming surface and terminal end of the attachment such as at 222A in FIG. 5 is suitably dimensioned to ensure that it is out of contact with the projecting ball after it rolls off the camming surface to facilitate free release of the tool attachment without undesired drag. Finally, the detent ball and spring mechanism may be mounted in the tool attachment, and the recess and camming surface may be formed within the internal walls of the tool body to coact with the locking detent in accordance with this invention.

As will be apparent to persons skilled in the art, various modifications, adaptations and variations of the foregoing specific disclosure can be made without departing from the teachings of this invention.

I claim:

1. A tool comprising a body having a drive member with a non-circular opening therein, and a releasable tool attachment having a fastener driving element and connected shank, the shank being dimensioned and configured to be inserted into the opening into an operating position in driving engagement with the drive member, one of the drive and shank members having a camming surface, the other of the drive and shank members having resiliently biased ejection means engageable with the camming surface upon discrete movement of the shank from its operating position relative to the drive member in a tool attachment release direction, the ejection means and the camming surface cooperating upon engagement to apply an axial driving force to the attachment for positively ejecting the attachment from the tool body.

2. The tool of claim 1 wherein the opening extends through the drive member, wherein the tool attachment has an exposed terminal end opposite the fastener driving element, wherein a recess is formed on said one of the drive and shank members adjacent said camming surface, wherein the ejection means comprises a locking detent mounted in said other of the drive and shank members, the detent being resiliently biased into seating engagement within the recess for releasably securing the attachment in operating position, and wherein the terminal end of the tool attachment is manually depressible for disengaging the detent from the recess to initiate release of the attachment prior to its being automatically ejected from the tool body by the biasing force of the detent acting on the camming surface.

3. The tool of claim 2 wherein the camming surface is disposed between the recess and the terminal end of the tool attachment in operating position, the camming surface and the recess being aligned in parallel relation to the axis of movement of the tool attachment.

4. The tool of claim 2 wherein the recess and camming surface are each formed in the shank of the tool attachment, and wherein the detent is mounted in the drive member of the tool body.

5. The tool of claim 4 wherein the drive member includes internal drive surfaces surrounding said opening, wherein the shank of the attachment includes a drive section having external drive surfaces engageable with said internal drive surfaces, wherein the shank includes a section of enlarged cross-sectional area in axially aligned relation to the drive section with the recess being formed in the enlarged section in longitudinally displaced relation to the drive section, and wherein the maximum cross-sectional area of the drive section is less than the minimum cross-sectional area of said enlarged section in a plane containing the recess.

6. The tool of claim 2 wherein the shank of the attachment includes a drive section and an axially aligned intermediate section between the drive section of the shank and the fastener driving element, wherein the intermediate section is of enlarged cross-sectional area relative to the drive section, and wherein a shoulder is formed on the shank of the attachment between the drive section and the intermediate section, the attachment shoulder being in disengaged relation to the drive member upon insertion of the attachment into the opening of the drive member in said operating position.

7. The tool of claim 6 wherein the recess is formed in the intermediate shank section of the tool attachment, wherein the detent is resiliently mounted in the drive member of the tool body in registration with the recess when the attachment is in its operating position within the tool body, and wherein the shoulder of the attachment comprises the camming surface.

8. The tool of claim 6 wherein the drive section of the shank has a square cross-section, wherein the opening of the drive member is of square cross-section for receiving the shank drive section in driving engagement, wherein the recess is formed in the square drive section of the attachment, wherein a chamber is formed in the drive member registrable with the recess upon positioning the tool attachment in operating position within the drive member, wherein the detent comprises a ball mounted in the chamber in the drive member, and wherein a spring is seated within the chamber and resiliently biases the ball toward the recess for releasably retaining the attachment in operating position.

9. The tool of claim 2 wherein the tool attachment includes a longitudinally extending surface in aligned recessed relation to the camming surface and merging therewith in non-interfering relation to the detent to eliminate frictional drag on the attachment during its ejection from the tool body.

10. The tool of claim 1 wherein the tool attachment includes a flared neck section connected in coaxially aligned relation between the shank and fastener driving element, wherein the axial length of the shank received within the drive member opening is greater than the combined axial length of the flared neck section and fastener driving element, and wherein the axial dimension of the flared neck section is less than the axial length of the fastener driving element, whereby the overall axial length of the tool attachment is relatively reduced while the axial length of the shank in driving engagement with the drive member is relatively increased for improved tool stability and minimized tolerance requirements.

* * * * *